US009829818B2

(12) United States Patent
Yoshiba et al.

(10) Patent No.: US 9,829,818 B2
(45) Date of Patent: Nov. 28, 2017

(54) TONER

(71) Applicant: CANON KABUSHIKI KAISHA, Tokyo (JP)

(72) Inventors: Daisuke Yoshiba, Suntou-gun (JP); Katsuhisa Yamazaki, Numazu (JP); Koji Nishikawa, Susono (JP); Shotaro Nomura, Suntou-gun (JP); Hiroki Akiyama, Toride (JP); Masami Fujimoto, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/852,870

(22) Filed: Sep. 14, 2015

(65) Prior Publication Data

US 2016/0091813 A1 Mar. 31, 2016

(30) Foreign Application Priority Data

Sep. 30, 2014 (JP) ..... 2014-200109

(51) Int. Cl.
*G03G 9/087* (2006.01)

(52) U.S. Cl.
CPC ..... *G03G 9/08797* (2013.01); *G03G 9/08755* (2013.01); *G03G 9/08788* (2013.01); *G03G 9/08791* (2013.01)

(58) Field of Classification Search
CPC ..... G03G 9/08755; G03G 9/08788; G03G 9/08791; G03G 9/08711; G03G 9/08797
USPC ..... 430/109.4
See application file for complete search history.

(56) References Cited

U.S. PATENT DOCUMENTS

| | | | |
|---|---|---|---|
| 6,203,959 | B1 | 3/2001 | Tanikawa et al. |
| 7,147,981 | B2 | 12/2006 | Fujikawa et al. |
| 7,273,686 | B2 | 9/2007 | Onuma et al. |
| 7,288,354 | B2 | 10/2007 | Moribe et al. |
| 7,351,509 | B2 | 4/2008 | Moribe et al. |
| 7,638,251 | B2 | 12/2009 | Yamazaki et al. |
| 8,026,030 | B2 | 9/2011 | Moribe et al. |
| 8,057,977 | B2 | 11/2011 | Moribe et al. |
| 8,293,447 | B2 | 10/2012 | Yamazaki et al. |
| 8,614,044 | B2 | 12/2013 | Matsui et al. |
| 8,778,585 | B2 | 7/2014 | Matsui et al. |
| 9,097,998 | B2 | 8/2015 | Yamazaki et al. |
| 9,128,400 | B2 | 9/2015 | Takahashi et al. |
| 2005/0106485 | A1 | 5/2005 | Yamazaki et al. |
| 2013/0252167 | A1 | 9/2013 | Moribe et al. |
| 2013/0309603 | A1 | 11/2013 | Takahashi et al. |
| 2014/0004460 | A1 | 1/2014 | Yoshiba et al. |
| 2014/0030645 | A1 | 1/2014 | Nomura et al. |
| 2015/0037719 | A1 | 2/2015 | Naka et al. |
| 2015/0037722 | A1 | 2/2015 | Yamazaki et al. |
| 2015/0037723 | A1 | 2/2015 | Nishikawa et al. |
| 2015/0037726 | A1 | 2/2015 | Nomura et al. |
| 2015/0037728 | A1* | 2/2015 | Moribe ..... G03G 9/08755 430/109.4 |
| 2015/0037729 | A1 | 2/2015 | Yoshiba et al. |
| 2015/0177635 | A1* | 6/2015 | Fukudome ..... G03G 9/107 430/109.4 |
| 2015/0220013 | A1 | 8/2015 | Nishikawa et al. |

FOREIGN PATENT DOCUMENTS

| | | | |
|---|---|---|---|
| JP | 2006-258963 | A | 9/2006 |
| JP | 2010-26185 | A | 2/2010 |
| JP | 4858165 | B2 | 1/2012 |

OTHER PUBLICATIONS

Okitsu, "Technology on Adhesion & Sealing", vol. 40, No. 8, 1996, pp. 342-350.

* cited by examiner

*Primary Examiner* — Janis L Dote
(74) *Attorney, Agent, or Firm* — Fitzpatrick Cella Harper and Scinto

(57) ABSTRACT

Provided is a toner that uses a crystalline resin, and demonstrates favorable dispersibility of the crystalline resin in the toner, demonstrates superior low-temperature fixability, and is able to inhibit fogging. The toner has a toner particle comprising a resin A, which has a long-chain alkyl group having an average number of carbon atoms of 27 to 50, and a crystalline resin, wherein the SP value $(cal/cm^3)^{1/2}$ of the crystalline resin is 9.00 to 12.00, and in a GC/MS analysis of components that volatize when the toner is heated for 10 minutes at 200° C., the amount of volatile components of saturated hydrocarbons having 30 to 37 carbon atoms is 90 ppm to 260 ppm of toluene equivalent, based on mass.

2 Claims, No Drawings

TONER

BACKGROUND OF THE INVENTION

Field of the Invention

The present invention relates to a toner used in a recording method such as electrophotography.

Description of the Related Art

In recent years, electrophotographic devices have been required to demonstrate improved toner low-temperature fixability in order to achieve greater energy savings. Crystalline resins represented by crystalline polyester, which are able to realize both low-temperature fixability and storability, are attracting attention as toner constituent materials. Crystalline resins have a melting point, and in addition to melting rapidly at that melting point, are expected to demonstrate considerable improvement of low-temperature fixability by plasticizing other resins.

For example, Japanese Patent No. 4858165 proposes a toner that contains an amorphous polyester resin, which is synthesized using at least one type of alkyl succinic acid, alkenyl succinic acid and anhydride thereof as an acidic component, and a crystalline polyester resin.

This publication describes that the occurrence of minute melting unevenness during toner melting is inhibited and, even when thermal variation occurs during toner fixing, high-quality color images are obtained without the occurrence of offset and other fixing defects or uneven image gloss values even in regions of high image density by using an aliphatic crystalline polyester resin for the crystalline polyester resin and combining with the use of amorphous polyester resins of different molecular weights having a long-chain alkyl group or alkenyl group.

On the other hand, crystalline resins tend to exhibit inadequate dispersion in toner, and dispersion diameter becomes large or the composition, including other materials, becomes heterogeneous, and as a result thereof, these resins easily cause broadening of charge distribution. Moreover, "fogging", in which toner is developed in the margin of an image, tends to occur easily, thereby leaving room for improvement.

Toner containing binder resin in the form of crystalline polyester and amorphous polyester, and to which has been added silica particles having fatty acid amide supported on the surface thereof, has been proposed in Japanese Patent Application Laid-open No. 2010-26185, for example, as a technology for improving the dispersibility of crystalline polyester resin.

This publication describes that the use of silica particles having fatty acid amide supported on the surface thereof makes it possible to uniformly crystallize crystalline polyester in toner particles and prevent decreases in toner storage stability, thereby making it possible to prevent the occurrence of toner particle aggregation. However, the addition of inorganic particles in the form of silica particles has the potential to cause a thickening effect. Thus, from the viewpoint of low-temperature fixability, it is necessary to improve the dispersibility of crystalline polyester without relying on inorganic particles.

In addition, Japanese Patent Application Laid-open No. 2006-258963 proposes a toner obtained by carrying out a melting and kneading step using a toner composition comprising a raw material containing a crystalline resin, an amorphous resin and a colorant, and a powder derived from the raw material having a volume-based median particle diameter (D50) of 0.5 μm to 8 μm, followed by going through a cooling step, a pulverizing step, a classifying step and a surface treatment step.

According to this publication, although a toner is obtained that has favorable durability and low-temperature fixability, a plurality of kneading step is substantially required, and there is still room for improvement when considering such factors as productivity.

SUMMARY OF THE INVENTION

An object of the present invention is to provide a toner that uses a crystalline resin, wherein the dispersibility of the crystalline resin in the toner is favorable, and the toner has superior low-temperature fixability and is able to inhibit fogging.

The present invention relates to a toner having a toner particle comprising a resin A, which has a long-chain alkyl group having an average number of carbon atoms of 27 to 50, and a crystalline resin, wherein the SP value $(cal/cm^3)^{1/2}$ of the crystalline resin is 9.00 to 12.00, and in a GC/MS analysis of components that volatize when the toner is heated for 10 minutes at 200° C., an amount of volatile components of saturated hydrocarbons having 30 to 37 carbon atoms is 90 ppm to 260 ppm of toluene equivalent, based on mass.

According to the present invention, a toner that uses a crystalline resin can be provided that demonstrates favorable dispersibility of the crystalline resin in the toner, demonstrates superior low-temperature fixability, and is able to inhibit fogging.

Further features of the present invention will become apparent from the following description of exemplary embodiments.

DESCRIPTION OF THE EMBODIMENTS

The toner of the present invention is a toner that has a toner particle comprising a resin A, which has a long-chain alkyl group having an average of 27 to 50 carbon atoms, and a crystalline resin; wherein, the SP value $(cal/cm^3)^{1/2}$ of the crystalline resin is 9.00 to 12.00, and in a GC/MS (gas chromatography/mass spectroscopy) analysis of components that volatize when the toner is heated for 10 minutes at 200° C., the amount of volatile components of saturated hydrocarbons having 30 to 37 carbon atoms is 90 ppm to 260 ppm of toluene equivalent, based on mass.

[Resin A]

The inventors of the present invention conducted extensive studies on a toner material composition having superior low-temperature fixability.

As a result thereof, the use of an amorphous resin having a long-chain alkyl group having an average of 27 to 50 carbon atoms and the further use of a fixation-improving assistant in the form of a crystalline resin were found to enable a dramatic improvement in fixability.

Resin A is a resin that has a long-chain alkyl group having an average of 27 to 50 carbon atoms and a crystal segment or low softening component.

As a result of the resin A undergoing melting and plasticizing starting from this crystal segment or low softening component, the resin A softens at a lower temperature resulting in improved low-temperature fixability.

In the resin A, the average number of carbon atoms of the long-chain alkyl group is 27 to 50 and preferably 30 to 40 in order to realize both storability and low-temperature fixability.

In addition, the resin A preferably has 2.5% by mass to 10.0% by mass, and more preferably 3.5% by mass to 7.5% by mass, of the long-chain alkyl group based on the mass of the resin A in order to efficiently obtain the effect of the long-chain alkyl group on low-temperature fixability while inhibiting a decrease in storage stability.

The average number of carbon atoms (average carbon chain length) of the long-chain alkyl group in the present invention is determined according to the method indicated below.

The distribution of the number of carbon atoms of the long-chain alkyl components is measured in the manner indicated below by gas chromatography (GC). Resin A is used for the sample. 10 mg of the sample are accurately weighed and placed in a sample bin. Hexane accurately weighed to 10 g is then added into the sample bin, and the bin is covered with a cap, followed mixing while heating is implemented to a temperature of 150° C. with a hot plate. Subsequently, the sample is immediately injected into a gas chromatography injection port to prevent precipitation of the long-chain alkyl components followed by analysis to obtain a chart in which the number of carbon atoms is plotted on the horizontal axis and signal intensity is plotted on the vertical axis. Next, the ratio of peaks corresponding to each number of carbons to the total area of all extracted peaks on the resulting chart is calculated and this is taken to be the abundance ratio (area %) of each hydrocarbon compound. A carbon number distribution chart is then prepared by plotting the number of carbons on the horizontal axis and plotting the abundance ratios (area %) of the hydrocarbon compounds on the vertical axis.

Average carbon chain length in the present invention refers to the carbon chain length at the top of the peak on a carbon number distribution chart.

Measurement devices and measurement conditions are as indicated below.

GC: Model 6890GC, Hewlett-Packard Co.

Column: Ultra Alloy-1 P/N, UA1-30m-0.5F (Frontier Laboratories, Ltd.)

Carrier gas: He

Oven: (1) holding for 5 minutes at a temperature of 100° C., (2) raising the temperature to 360° C. at the rate of 30° C./min, and (3) holding at a temperature of 360° C. for 60 minutes Injection port temperature: 300° C.

Initial pressure: 10.523 psi

Split ratio: 50:1

Column flow rate: 1 mL/min

The additional use of a crystalline resin as a fixation-improving assistant in the present invention makes it possible to synergistically improve low-temperature fixability. Namely, the crystalline resin has a melting point, and in addition to melting rapidly at that melting point, is able to significantly improve low-temperature fixability by plasticizing other resin components.

Here, the term "crystalline" refers to having a well-defined endothermic peak and not undergoing a stepwise change in endothermic quantity in differential scanning calorimetric measurement (DSC).

In this manner, the combined use of a resin having a long-chain alkyl group having an average of 27 to 50 carbon atoms with a crystalline resin makes it possible to improve low-temperature fixability due to the synergistic effect thereof.

However, in the case of using a crystalline resin, it is necessary to improve the dispersibility thereof as was previously described.

The inventors of the present invention conducted extensive studies to improve the dispersibility of crystalline resin in a toner composition using a resin having a long-chain alkyl group having an average of 27 to 50 carbon atoms and a crystalline resin.

As a result thereof, it was found that the dispersibility of a crystalline resin can be improved by controlling the SP value of the crystalline resin and the amount of saturated hydrocarbons present in the toner to predetermined amounts.

Namely, it is necessary that:

(i) a solubility parameter in the form of the SP value $(cal/cm^3)^{1/2}$ of the crystalline resin be from 9.00 to 12.00, and that (ii) in a GC/MS analysis of components that volatize when the toner is heated for 10 minutes at 200° C., the amount of volatile components of saturated hydrocarbons having 30 to 37 carbon atoms (to also be referred to as the amount of saturated hydrocarbons) be 90 ppm to 260 ppm of toluene equivalent, based on mass.

Although the mechanism by which dispersibility of the crystalline resin improves as a result of employing the aforementioned composition is unclear, by using a predetermined amount of saturated hydrocarbons having 30 to 37 carbon atoms in a toner, the saturated hydrocarbons are thought to interact with the crystalline resin having an SP value $(cal/cm^3)^{1/2}$ of 9.00 to 12.00 and act as a dispersing agent on the crystalline resin. As a result, a toner can be obtained in which dispersibility of the crystalline resin improves, charging performance becomes uniform and the occurrence of fogging can be inhibited.

In the case the amount of volatile components of the saturated hydrocarbons is less than 90 ppm, it is difficult to obtain the effect of improving dispersibility, while if that amount exceeds 260 ppm, the dispersing effect fails to act properly resulting in a greater likelihood of encountering difficulty in maintaining a properly dispersed state. The amount of volatile components of the saturated hydrocarbons is preferably 100 ppm to 240 ppm.

In addition, in the case of using a crystalline resin having solubility parameter in the form of SP value $(cal/cm^3)^{1/2}$ of less than 9.00 or greater than 12.00 for the crystalline resin, affinity with saturated hydrocarbons having 30 to 37 carbon atoms becomes low, thereby making it difficult to adequately obtain a dispersion effect.

In this manner, the present invention is characterized by having found the proper SP value of a crystalline resin and the proper amount of saturated hydrocarbons present in a toner for improving dispersibility of the crystalline resin.

In the present invention, the amount of saturated hydrocarbons having 30 to 37 carbon atoms present in the toner is measured by GC/MS analysis of components that volatize when the toner is heated for 10 minutes at 200° C.

This is preferable because the amount of saturated hydrocarbons having 30 to 37 carbon atoms present in the toner can be detected with favorable accuracy as a result of heating for 10 minutes at 200° C.

The specific measurement method is indicated below.

<Measurement of Amount of Volatile Components of Saturated Hydrocarbons (Amount of Saturated Hydrocarbons) Having 30 to 37 Carbon Atoms Using a Thermal Desorption Device>

The amount of volatile components of saturated hydrocarbons having 30 to 37 carbon atoms in the present invention is measured using the method indicated below. Furthermore, thermal desorption is carried out by auto thermal desorption (ATD). The measuring device indicated below is used for the measuring device.

Thermal desorption device: TurboMatrix ATD (Perkin-Elmer Corp.)

GC/MS system: TRACE DSQ (Thermal Fisher Scientific K.K.)

(Fabrication of Glass Tube Containing Internal Standard)

A glass tube was preliminarily fabricated for a thermal desorption device in which 10 mg of Tenax TA adsorbent was sandwiched between glass wool followed by conditioning for 3 hours at a temperature of 300° C. in the presence of an inert atmospheric gas flow. Subsequently, 5 μL of a methanol solution containing 100 ppm of toluene (based on volume) was adsorbed by the Tenax TA to obtain a glass tube containing an internal standard. Furthermore, in the present invention, toluene was used as an internal standard. The amounts of volatile components in the present invention were all indicated as the amount of toluene equivalent. Furthermore, the method used to convert the amounts of volatile components will be subsequently described.

(Measurement of Toner)

Toner weighed to about 1 mg is wrapped in glass wool baked at a temperature of 300° C. and placed in special-purpose tube prepared as described above (Fabrication of Glass Tube Containing Internal Standard). This sample was sealed in the tube with a Teflon® cap for use with the thermal desorption device and then placed in the thermal desorption device. The sample is measured under the conditions indicated below followed by calculation of the retention times and peak areas attributable to volatile components of the internal standard and the total peak area of saturated hydrocarbons having 30 to 37 carbon atoms obtained by subtracting peaks attributable to volatile components of the internal standard.

(Thermal Desorption Device Conditions)

Tube temperature: 200° C.

Transfer temperature: 300° C.

Bulb temperature: 300° C.

Column pressure: 150 kPa

Inlet split: 25 ml/min

Outlet split: 10 ml/min

Secondary adsorption tube material: Tenax TA

Retention time: 10 min

Secondary adsorption tube temperature during adsorption: −30° C.

Secondary adsorption tube adsorption temperature: 300° C.

(GC/MS Conditions)

Column: Ultra Alloy (metal column) UT-5 (inner diameter: 0.25 nm, liquid phase: 0.25 μm, length: 30 m)

Column heating conditions: 60° C. (retention time: 3 min), temperature raised from 60° C. to 350° C. (ramp rate: 20.0° C./min), 350° C. (retention time: 10 min)

Furthermore, the transfer line of the thermal desorption device is coupled directly with the GC column, and the GC injection port is not used.

(Analysis)

The total peak area of saturated hydrocarbons having 30 to 37 carbon atoms, obtained by subtracting the peak corresponding to toluene used as an internal standard, is calculated among the peaks obtained under the above-mentioned conditions. The amount of volatile components of the saturated hydrocarbons having 30 to 37 carbon atoms in the toner is calculated according to the equation indicated below. At this time, caution is used to so as not to include different peaks such as noise peaks in the integration value.

$$\text{Amount of volatile components of saturated hydrocarbons having 30 to 37 carbon atoms in toner (ppm)} = [(a1/b1)\times\{(100\times5/10^6)\times d1\}/c1]\times10^6$$

a1: Total peak area of saturated hydrocarbons having 30 to 37 carbon atoms b1: Peak area of toluene (internal standard)

c1: Mass of weighed toner (mg)

d1: Density of toluene (internal standard)

In the present invention, although there are no particular limitations on the method used to control the amount of saturated hydrocarbons having 30 to 37 carbon atoms present in the toner, an example thereof consists of controlling the production method used when producing resin A having a long-chain alkyl group.

This long-chain alkyl group represents a monovalent group formed as a result of the loss of a hydrogen atom from an aliphatic hydrocarbon, while resin A having a long-chain alkyl group having an average of 27 to 50 carbon atoms indicates a resin in which an aliphatic hydrocarbon segment having an average of 27 to 50 carbon atoms is incorporated in the resin.

Although there are various methods for incorporating a long-chain alkyl group in a resin, a long-chain alkyl group can be incorporated in resin A by modifying a portion of an aliphatic hydrocarbon with a reactive substituent (such as an OH group or carboxy group) to form a long-chain alkyl monomer followed by chemically reacting this with another reactive segment present in resin A.

An unmodified aliphatic hydrocarbon component remains in this aliphatic hydrocarbon modification reaction. Since the amount of this unmodified component correlates with the amount of saturated hydrocarbon component having 30 to 37 carbon atoms, controlling the modification rate thereof makes it possible to control the amount of saturated hydrocarbons present in the toner. In the present invention, the resin A may contain saturated hydrocarbons or saturated hydrocarbons may be added separately.

In other words, the saturated hydrocarbon component in the toner can be controlled to within the range of the present invention by controlling the modification rate of the long-chain alkyl component.

Conventionally, in the case of attempting to obtain a resin having a long-chain alkyl group, the long-chain alkyl modification rate was low at about 50% to 70% and a large number of unmodified aliphatic hydrocarbon components were present in the resin. As a result, in the case of using a conventional long-chain alkyl monomer having a low modification rate, the amount of aliphatic hydrocarbons having 30 to 37 carbon atoms in the toner easily exceeded 260 ppm.

As a result of conducting extensive studies, the inventors of the present invention found that the amount of saturated hydrocarbons having 30 to 37 carbon atoms present in the toner can be controlled by increasing the modification rate when subjecting aliphatic hydrocarbons to a modification reaction. More specifically, the amount of the unmodified aliphatic hydrocarbon component was adjusted and controlled to within the range of the present invention by optimizing reaction conditions and carrying out a purification procedure following the modification reaction.

In the present invention, the modification rate of the long-chain alkyl component is preferably 76% to 99% and more preferably 80% to 98%. Furthermore, modification rate in the present invention refers to the ratio of the number of functional groups introduced by modification to the number of molecules of the long-chain alkyl component, and becomes a value of 100% if the number of introduced functional groups is equal to the number of molecules of the long-chain alkyl component. The number of molecules of the long-chain alkyl component is calculated using the average number of carbon atoms, while the number of introduced functional groups can be determined by measuring hydroxyl value or acid value.

The resin A according to the present invention is preferably a polyester-based resin, and the long-chain alkyl group of resin A is more preferably formed by at least one member of the group consisting of long-chain alkyl monocarboxylic acids having an average of 27 to 50 carbon atoms and long-chain alkyl monoalcohols having an average of 27 to 50 carbon atoms condensing on the end of the polyester segment.

In the present invention, a polyester-based resin represents a resin in which 50% by mass or more of the constituents of the resin A are composed of a polyester resin or polyester segment.

The use of a polyester-based resin for the resin A results in favorable low-temperature fixability regardless of the environment. In addition, a long-chain alkyl alcohol and/or long-chain alkyl carboxylic acid can be used as the long-chain alkyl monomer for forming the long-chain alkyl group, and can be incorporated in a polyester-based resin component by an esterification reaction. Introduction of a long-chain alkyl group into a resin using an esterification reaction is preferable since the resin can be made to uniformly retain the long-chain alkyl component.

Moreover, in the present invention, a long-chain alkyl monomer having a secondary monoalcohol as a main component thereof is preferably contained as the long-chain alkyl monomer that forms the long-chain alkyl group.

The use of a long-chain alkyl monoalcohol component for the long-chain alkyl monomer is preferable since it makes it easier to control modification rate.

In addition, the use of a long-chain alkyl monoalcohol having a secondary alcohol as a main component thereof facilitates the adoption of a folded structure by the long-chain alkyl component in the resin A. As a result, steric hindrance is inhibited, the long-chain alkyl component is uniformly distributed in the polyester-based resin composition more easily, and storage stability is further improved, thereby making this preferable.

An example of a method of obtaining a long-chain alkyl monoalcohol consists of oxidizing an aliphatic hydrocarbon having 27 to 50 carbon atoms in the liquid phase with a molecular oxygen-containing gas in the presence of a catalyst such as boric acid, anhydrous boric acid or metaboric acid to obtain an alcohol-modified product.

The added amount of the catalyst used is preferably 0.01 moles to 0.5 moles based on 1 mole of the raw material aliphatic hydrocarbon. Although oxygen, air or a wide range of these diluted with an inert gas can be used for the molecular oxygen-containing gas blown into the reaction system, the oxygen concentration is preferably 3% to 20%. In addition, reaction temperature is 100° C. to 200° C.

In addition, by optimizing the reaction conditions and carrying out a purification procedure using a nonpolar solvent following the modification reaction in order to properly control the modification rate, the amount of unmodified aliphatic hydrocarbon components can be adjusted and controlled to within the range of the present invention.

In the case the resin A is a polyester-based resin, the long-chain alkyl monomer is preferably added simultaneous to other monomers that compose the polyester resin and subjected to condensation polymerization. As a result thereof, the long-chain alkyl monomer can be adequately introduced into the polyester resin. As a result, melting of the polyester-based resin is promoted and low-temperature fixability is further improved, thereby making this preferable.

In addition, the resin A is preferably a hybrid resin in which a polyester segment and vinyl-based polymer segment are chemically bonded. The vinyl-based polymer segment is preferably a vinyl-based copolymer segment.

The use of a hybrid resin is preferable since stable charging performance is obtained in a high-temperature, high-humidity environment and image density becomes more stable.

In addition, the mass ratio of the polyester segment to the vinyl-based polymer segment (polyester segment/vinyl-based polymer segment) is preferably 50/50 to 90/10 and more preferably 60/40 to 80/20. If made to be within the above-mentioned ranges, stable low-temperature fixability is easily obtained regardless of the environment while obtaining the merits of using a hybrid resin as previously described, thereby making this preferable.

Examples of the polyester-based monomer that composes the polyester resin used in the resin A according to the present invention or the polyester segment of the above-mentioned hybrid resin include the compounds indicated below. Examples of alcohol components include the following: ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, bisphenol derivatives represented by the following formula (1) and diols represented by the following formula (2):

[Chemical Formula 1]

(1)

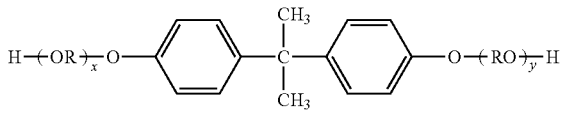

(wherein, R represents an ethylene group or propylene group, x and y respectively represent an integer of 1 or more, and the average value of x+y is 2 to 10);

[Chemical Formula 2]

(2)

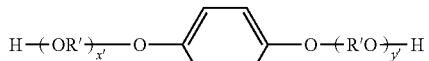

wherein, R′ represents $-CH_2CH_2-$, $-CH_2-CH(CH_3)-$ or $-CH_2-C(CH_3)_2-$, x′ and y′ respectively represent an integer of 1 or more, and the average value of x′ + y′ is 2 to 10.

In the case of using a bisphenol derivative represented by formula (1) above, the molar ratio (EO:PO) of an ethylene oxide adduct (EO) to a propylene oxide adduct (PO) in the present invention is preferably 40:60 to 60:40. Controlling the EO:PO ratio to be within this range results in the long-chain alkyl component being more uniformly dispersed in the resin and improved storage stability, thereby making this preferable.

Examples of acid components include: benzene dicarboxylic acids and anhydrides thereof such as phthalic acid, terephthalic acid, isophthalic acid or phthalic anhydride, alkyl dicarboxylic acids and anhydrides thereof such as succinic acid, adipic acid, sebacic acid or azelaic acid, succinic acid that have been substituted with an alkyl group or alkenyl group having 6 to 18 carbon atoms and anhydrides thereof, and unsaturated dicarboxylic acids and anhydrides thereof such as fumaric acid, maleic acid, citraconic acid or itaconic acid.

In addition, the polyester resin or polyester segment according to the present invention is preferably a polyester resin that contains a crosslinked structure formed by a polyvalent carboxylic acid having a valence of three or more or an anhydride thereof and/or a polyvalent alcohol having a valence of three or more. Examples of polyvalent carboxylic acids having a valence of three or more and anhydrides thereof include 1,2,4-benzene tricarboxylic acid, 1,2,4-cyclohexane tricarboxylic acid, 1,2,4-naphthalene tricarboxylic acid, pyromellitic acid and acid anhydrides or lower alkyl esters thereof. Examples of polyvalent alcohols having a valence of three or more include 1,2,3-propanetriol, trimethylolpropane, hexanetriol and pentaerythritol. In the resin A of the present invention, an aromatic alcohol that is highly stable with respect to environmental fluctuations is particularly preferable, and examples thereof include 1,2,4-benzene tricarboxylic acid and anhydrides thereof.

Examples of the vinyl-based monomer that composes the vinyl-based resin used in the resin A according to the present invention or the vinyl-based polymer segment of a hybrid resin include styrene, styrene and derivatives thereof in the manner of o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene or p-n-dodecylstyrene, styrene unsaturated monoolefins in the manner of ethylene, propylene, butylene or isobutylene, unsaturated polyenes in the manner of butadiene or isoprene, vinyl halides in the manner of vinyl chloride, vinylidene chloride, vinyl bromide, or vinyl fluoride, vinyl esters in the manner of vinyl acetate, vinyl propionate or vinyl benzoate, α-methylene aliphatic monocarboxylic acid esters in the manner methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate or diethylaminoethyl methacrylate, acrylic acid esters in the manner of methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate or phenyl acrylate, vinyl ethers in the manner of vinyl methyl ether, vinyl ethyl ether or vinyl isobutyl ether, vinyl ketones in the manner of vinyl methyl ketone, vinyl hexyl ketone or methyl isopropenyl ketone, N-vinyl compounds in the manner of N-vinylpyrrole, N-vinylcarbazole, N-vinylindole or N-vinylpyrrolidone, vinylnaphthalene and acrylic acid or methacrylic acid derivatives in the manner of acrylonitrile, methacrylonitrile or acrylamide.

Moreover, additional examples include unsaturated dibasic acids in the manner of maleic acid, citraconic acid, itaconic acid, alkenyl succinic acid, fumaric acid or mesaconic acid, unsaturated dibasic acid anhydrides in the manner of maleic anhydride, citraconic anhydride, itaconic anhydride or alkenyl succinic anhydride, half esters of unsaturated dibasic acids in the manner of methyl maleic acid half ester, ethyl maleic acid half ester, butyl maleic acid half ester, methyl citraconic acid half ester, ethyl citraconic acid half ester, butyl citraconic acid half ester, methyl itaconic acid half ester, methyl alkenyl succinic acid half ester, methyl fumaric acid half ester or methyl mesaconic acid half ester, unsaturated dibasic acid esters in the manner of dimethyl maleate or dimethyl fumarate, α,β-unsaturated acids in the manner of acrylic acid, methacrylic acid, crotonic acid or cinnamic acid, α,β-unsaturated acid anhydrides in the manner of crotonic anhydride or cinnamic anhydride, anhydrides of those α,β-unsaturated acids and lower fatty acids, and monomers having a carboxyl group in the manner of alkenyl malonic acids, alkenyl glutaric acids, alkenyl adipic acids, anhydrides thereof or monoesters thereof.

Moreover, other examples include acrylic acid esters or methacrylic acid esters in the manner of 2-hydroxyethyl acrylate, 2-hydroxyethyl methacrylate or 2-hydroxypropyl methacrylate, and monomers having a hydroxyl group in the manner of 4-(1-hydroxy-1-methylbutyl)styrene or 4-(1-hydroxy-1-methylhexyl)styrene.

In the toner of the present invention, the vinyl-based resin or vinyl-based polymer segment used in the resin A may have a crosslinked structure crosslinked with a crosslinking agent having two or more vinyl groups. Examples of the crosslinking agent used in this case include: aromatic divinyl compounds (divinylbenzene, divinylnaphthalene), diacrylate compounds linked by an alkyl chain (ethylene glycol diacrylate, 1,3-butylene glycol diacrylate, 1,4-butanediol diacrylate, 1,5-pentanediol acrylate, 1,6-hexanediol diacrylate, neopentyl glycol diacrylate and compounds in which the acrylate of the above-mentioned compounds has been substituted with methacrylate), diacrylate compounds linked with an alkyl chain containing an ether bond (diethylene glycol diacrylate, triethylene glycol diacrylate, tetraethylene glycol diacrylate, polyethylene glycol #400 diacrylate, polyethylene glycol #600 diacrylate, dipropylene glycol diacrylate and compounds in which the acrylate of the above-mentioned compounds has been substituted with methacrylate), diacrylate compounds linked with a chain containing an aromatic group and an ether bond (polyoxyethylene (2)-2,2-bis(4-hydroxyphenyl)propane diacrylate, polyoxyethylene (4)-2,2-bis(4-hydroxyphenyl)propane diacrylate and compounds in which the acrylate of the above-mentioned compounds has been substituted with methacrylate), and polyester-type diacrylate compounds (MANDA manufactured by Nippon Kayaku Co., Ltd.).

Examples of multifunctional crosslinking agents include pentaerythritol triacrylate, trimethylolethane triacrylate, trimethylolpropane triacrylate, tetramethylolmethane tetraacrylate, oligoester acrylate, compounds in which the acrylate of the above-mentioned compounds has been substituted with methacrylate, triallyl cyanurate and triallyl trimellitate.

These crosslinking agents can be used at preferably 0.01 parts by mass to 10.00 parts by mass and more preferably at 0.03 parts by mass to 5.00 parts by mass based on 100 parts by mass of the vinyl-based monomer.

Among these crosslinking agents, examples of those that are used preferably from the viewpoints of fixability and offset resistance include aromatic divinyl compounds (and particularly divinylbenzene) and diacrylate compounds linked with a chain containing an aromatic group and ether bond.

Examples of polymerization initiators used to polymerize the above-mentioned vinyl-based resin or vinyl-based polymer segment include 2,2'-azobisisobutyronitrile, 2,2'-azobis(4-methoxy-2,4-dimethylvaleronitrile), 2,2'-azobis(2,4-dimethylvaleronitrile), 2,2'-azobis(2-methylbutyronitrile), dimethyl-2,2'-azobisisobutyrate, 1,1'-azobis(1-cyclohexanecarbonitrile), 2-(carbamoylazo)-isobutyronitrile, 2,2'-azobis(2,4,4-trimethylpentane), 2-phenylazo-2,4-dimethyl-4-methoxyvaleronitrile, 2,2-azobis(2-methylpropane), ketone peroxides in the manner of methyl ethyl ketone peroxide, acetyl acetone peroxide or cyclohexanone peroxide, 2,2-bis(tert-butylperoxy)butane, tert-butylhydroperoxide, cumene hydroperoxide, 1,1,3,3-tetramethylbutyl hydroperoxide, di-tert-butylperoxide, tert-butylcumyl peroxide, dicumyl peroxide, α,α'-bis(tert-butylperoxyisopropyl)benzene, isobutyl peroxide, octanoyl peroxide, decanoyl peroxide, lauroyl peroxide, 3,5,5-trimethylhexanoyl peroxide, benzoyl peroxide, m-tolyloyl peroxide, diisopropyl peroxydicarbonate, di-2-ethylhexyl peroxydicarbonate, di-n-propyl peroxydicarbonate, di-2-ethoxyethyl peroxycarbonate, dimethoxyisopropyl peroxydicarbonate, di(3-methyl-3-methoxybutyl) peroxycarbonate, acetyl cyclohexyl sulfonyl peroxide, tert-butyl peroxyacetate, tert-butyl peroxyisobutyrate, tert-butyl peroxyneodecanoate, tert-butyl peroxy-2-ethylhexanoate, tert-butyl peroxylaurate, tert-butyl peroxybenzoate, tert-butyl peroxyisopropyl carbonate, di-tert-butyl peroxyisophthalate, tert-butyl peroxyallyl carbonate, tert-amyl peroxy-2-ethylhexanoate, di-tert-butyl peroxyhexahydroterephthalate and di-tert-butyl peroxyazelate.

In the present invention, in the case of using the above-mentioned hybrid resin for the resin A, monomer components capable of reacting with both resin components (to be referred to as bireactive monomers) are preferably contained in the vinyl-based polymer segment and/or polyester segment. Examples of monomers that compose the polyester segment that are able to react with the vinyl-based polymer segment include unsaturated dicarboxylic acids and anhydrides thereof in the manner of fumaric acid, maleic acid, citraconic acid or itaconic acid. Examples of monomers that compose the vinyl-based polymer segment capable of reacting with the polyester segment include monomers having a carboxyl group or hydroxyl group, acrylic acid, methacrylic acid and esters thereof.

The method used to chemically bond the vinyl-based polymer segment and polyester segment is preferably a method by subjecting one or both of the resins to a polymerization reaction in the presence of a polymer containing the bireactive monomers.

Furthermore, these bireactive monomers are monomers that compose the polyester segment when discussing the monomer content in the hybrid resin. This is because the bireactive monomers have a greater effect on the physical properties of the condensation polymerization-based resin (polyester segment) even in the case of carrying out the condensation polymerization reaction or addition polymerization reaction first.

In addition, although the resin A as previously described may be used alone, it may also be used in combination with other resins. In the case of combining the use of a plurality of resins, 50% by mass to 100% by mass of resin in the toner is preferably resin A having a long-chain alkyl group having an average of 27 to 50 carbon atoms. Namely, resin A is preferably a main component of a binder resin.

In the case it is preferable to use two types of resins having different softening points (high softening point resin (H) and low softening point resin (L)) for the combination when combining the use of resins, the softening point of the high softening point resin (H) is preferably 100° C. to 170° C., and the softening point of the low softening point resin (L) is preferably 70° C. to less than 100° C.

In the case of using one type resin A alone, the softening point Tm is preferably 90° C. to 170° C. and more preferably 100° C. to 130° C. If Tm is within the above-mentioned ranges, balance between hot offset resistance and low-temperature fixability is favorable.

Furthermore, softening point is measured in the manner described below. Measurement of resin softening point is carried out in accordance with the manual attached to a constant load extrusion type capillary rheometer in the form of the "CFT-500D Flow Tester Flow Characteristics Evaluation System" (Shimadzu Corp.). This device allows the obtaining of a flow curve indicating the relationship between piston descent and temperature by heating and melting a measurement sample filled into a cylinder while applying a constant load onto the top of the measurement sample with the piston followed by extruding the molten measurement sample from a die in the bottom of the cylinder.

In the present invention, the "melting temperature in the ½ method", described in the manual provided with the "CFT-500D Flow Tester Flow Characteristics Evaluation System", is used for the softening point. Furthermore, the melting temperature in the ½ method refers to the temperature calculated in the manner indicated below. First, ½ the difference between the piston descent Smax when the sample has finished flowing out and piston descent Smin when the sample started to flow out is determined (and this is defined as X, where X=(Smax−Smin)/2). The temperature on the flow curve when piston descent reaches the sum of X and Smin on the flow curve is the melting temperature Tm in the ½ method.

A sample obtained by compression molding about 1.0 g of sample for about 60 seconds at about 10 MPa using a tablet forming compressor (such as the NT-100H manufactured by NAP System Co., Ltd.) in an environment at 25° C. followed by molding into a cylindrical shape having a diameter of about 8 mm is used for the measurement sample.

Measurement conditions of the CFT-500D are as indicated below.

Testing mode: Ramping method
Starting temperature: 50° C.
Saturated temperature: 200° C.
Measurement interval: 1.0° C.
Ramp rate: 4.0° C./min
Piston cross-sectional area: 1.000 $cm^2$
Test load (piston load): 10.0 kgf (0.9807 MPa)
Preheating time: 300 sec
Die opening diameter: 1.0 mm
Die length: 1.0 mm The glass transition temperature (Tg) of the resin A is preferably 45° C. or higher from the viewpoint of storage stability. In addition, Tg is more preferably 75° C. or lower and particularly preferably 65° C. or lower from the viewpoint of low-temperature fixability.

The glass transition temperature (Tg) of the resin A is measured at a constant temperature and constant humidity in compliance with ASTM D3418-82 using the "Q2000" differential scanning calorimeter (TA Instruments Inc.). A sample obtained by accurately weighing out about 3 mg of the resin A is used for the sample. The sample is placed in an aluminum pan and the empty aluminum pan is used as a reference. The measuring temperature range is from 30° C. to 200° C., and after initially raising the temperature from 30° C. to 200° C. at a ramp rate of 10° C./min, the temperature is lowered from 200° C. to 30° C. at a drop rate of 10° C./min followed by again raising the temperature to 200° C. at a ramp rate of 10° C./min. The intersection of a line extending through the midpoint of the baseline before and after the appearance of a change in specific heat and the differential thermal curve on a DSC curve obtained during the course of the second rise in temperature is taken to be the glass transition temperature Tg of the resin.

[Crystalline Resin]

The crystalline resin used in the present invention has an SP value $(cal/cm^3)^{1/2}$ of 9.00 to 12.00 and preferably 9.5 to 11.0. Although there are no particular limitations on the crystalline resin provided the SP value thereof is within the above-mentioned ranges, it is preferably a crystalline polyester resin. Furthermore, SP value can be controlled by selecting the types and contents of monomers used. The SP value of a monomer tends to be higher the higher the polarity of the monomer. The amount of a monomer having a high SP value is increased in order to increase the SP value. On the other hand, the amount of monomer having a low SP value is increased in order to lower the SP value.

SP value in the present invention refers to the solubility parameter δ calculated according to the following equation (1) as indicated by Toshinao Okitsu in "ADHESION and SEALING", Vol. 40, No. 8, p. 342-350 (1996), Polymer Publication Society.

$$\delta=\Sigma\Delta F/\Sigma\Delta v \quad (1)$$

In equation (1), ΔF represents the molar attraction constant of each atomic group, Δv represents the molar volume of each atomic group (volume per mole), and their respective specific values are as indicated in the following table.

In addition, in the case the SP value of a mixture (such as a mixed solvent), the product of the solubility parameter and mole fraction of each component is calculated followed by determining the sum total thereof. More specifically, the SP value of a mixture is calculated according to equation (2).

$$\delta_{mix}=\phi_1\delta_1+\phi_2\delta_2+\ldots+\phi_n\delta_n \quad (2)$$

In equation (2), ϕn represents the mole fraction of the nth component, δn represents the solubility parameter of the nth component, and $\phi_1+\phi_2+\ldots+\phi_n=1$.

TABLE 1

| Atomic Group | ΔF | Δv | Atomic Group | ΔF | Δv | Atomic Group | ΔF | Δv |
|---|---|---|---|---|---|---|---|---|
| —CH3 | 205 | 31.8 | —OH (Diol) | 270 | 12 | —SH | 310 | 28 |
| —CH2— | 132 | 16.5 | —OH (Arom) | 238 | 12 | >SO2 | 675 | 11.4 |
| >CH— | 28.6 | −1 | —NH2 | 273 | 16.5 | >S═O | 485 | 11.4 |
| >CH— (Poly) | 28.6 | 1.9 | —NH2 (Arom) | 238 | 21 | —S— | 201 | 12 |
| >C< | −81 | 14.8 | —NH— | 180 | 8.5 | S═ | 201 | 23 |
| >C< (Poly) | −81 | 19.2 | —NH— (Link) | 180 | 4 | SO3 | 322 | 27.5 |
| CH2═ | 195 | 31 | —N< | 61 | −9 | SO4 | 465 | 31.8 |
| —CH═ | 116 | 13.7 | —N═ | 118 | 5 | >Si< | 16.3 | 0 |
| >CH═ | 24.2 | −2.4 | —N═ (Link) | 118 | 15 | PO4 | 374 | 28 |
| ═CH═ | 200 | 25 | —CN | 420 | 23 | H | 81 | 8 |
| —CH≡ | 100 | 6.5 | —CN (Arom) | 252 | 27 | —C6H5 (Arom) | 731 | 72 |
| —O— | 120 | 5.1 | —CN (Poly) | 420 | 27 | —C6H4 (Arom) | 655 | 62 |
| —O— (Arom,Lin) | 70 | 3.8 | —NO2 | 481 | 24 | —C6H3 (Arom) | 550 | 39 |
| —O— (Epoxy) | 176 | 5.1 | —NO2 (Arom) | 342 | 32 | —C6H2 (Arom) | 450 | 27 |
| —CO— | 286 | 10 | —NCO | 498 | 35 | —C6H5 (Poly) | 731 | 79 |
| —COOH— | 373 | 24.4 | —NHCO— | 690 | 18.5 | —C6H4 (Poly) | 655 | 69 |
| —COOH— (Arom) | 242 | 24.4 | >NHCO— | 441 | 5.4 | —C6H3 (Poly) | 550 | 47 |
| —COO— | 353 | 19.6 | —Cl (Mono) | 330 | 23 | —C6H2 (Poly) | 450 | 32 |
| —COO— (Poly) | 330 | 22 | —Cl (Di) | 250 | 25 | —(Cyclohexyl) | 790 | 97.5 |
| —O—CO—O— | 526 | 20 | —Cl (Tri,Tetra) | 235 | 27 | (Plus onto upper groups) | | |
| —CHO | 370 | 25 | —Cl (Arom) | 235 | 27 | 3 Member 1 in | +110 | +18 |
| —CHO (Arom) | 213 | 29 | —Cl (>C<) | 235 | 28 | 4 Member 1 in | +110 | +18 |
| —OH (Mono) | 395 | 10 | —Cl (Poly) | 270 | 27 | 5 Member 1 in | +110 | +16 |
| —OH (Ether) | 342 | 12 | —Br (mean) | 302 | 30 | 6 Member 1 in | +100 | +16 |
| —OH (H2O) | 342 | 12 | —F (mean) | 130 | 19 | Conjugated Double | +30 | −22 |
| —OH (Poly) | 282 | 17 | —F (Poly) | 110 | 21 | bond Ditto(Link) | +30 | −10 |

For example, the SP value of heptane is determined in the manner indicated below.

Heptane has an atomic group consisting of 2-$CH_3$ moieties and 5-$CH_2$— moieties. Calculation of ΣΔF and ΣΔv based on the values of each atomic group described in the table yields the results indicated below.

$$\Sigma\Delta F=205\times2+132\times5=1070$$

$$\Sigma\Delta v=31.8\times2+16.5\times5=146.1$$

Thus, the SP value of heptane according to the above-mentioned equation (1) is calculated in the manner indicated below.

$$\Sigma\Delta F/\Sigma\Delta v=1070/146.1=7.32$$

Although there are no particular limitations on the crystalline resin according to the present invention provided it has a well-defined endothermic peak in differential scanning calorimetric measurement (DSC), from the viewpoint of low-temperature fixability, the peak temperature of the maximum endothermic peak of the crystalline resin as measured by DSC is preferably 50.0° C. to 100.0° C. and more preferably 60° C. to 90° C. The peak temperature of the maximum endothermic peak can be controlled according to the types of monomers used.

In the case of using a crystalline polyester-based resin for the crystalline resin, examples of alcohol components used as a resin raw material monomer include, but are not limited to, ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol and 1,14-eicosadecanediol.

Among these, from the viewpoints of low-temperature fixability and heat resistance stability, an aliphatic diol having 6 to 18 carbon atoms is preferable and that having 8 to 14 carbon atoms is more preferable.

From the viewpoint of further enhancing crystallinity of the crystalline polyester resin, the content of the above-mentioned aliphatic diol in the alcohol component is preferably 80 mol % to 100 mol %.

A polyvalent alcohol component other than the above-mentioned aliphatic diol may be contained as an alcohol component for obtaining the crystalline polyester resin. Examples thereof include aromatic diols such as alkylene oxide adducts of bisphenol A containing a polyoxypropylene adduct of 2,2-bis(4-hydroxyphenyl)propane, a polyoxyethylene adduct of 2,2-bis(4-hydroxyphenyl)propane or the like, and alcohols having a valence of three or more such as glycerin, pentaerythritol and trimethylolpropane.

Examples of carboxylic acid components used as a raw material monomer of the crystalline polyester resin include aliphatic dicarboxylic acids such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid or 1,18-octadecanedicarboxylic acid, aromatic dicarboxylic acids such as dibasic acids such as phthalic acid, isophthalic acid, terephthalic acid, naphthalene-2,6-dicarboxylic acid, malonic acid or mesaconic acid, and anhydrides and lower alkyl esters thereof.

Among these, aliphatic dicarboxylic acid compounds having 6 to 18 carbon atoms are used preferably, while those having 6 to 10 carbon atoms are used more preferably, from the viewpoint of enhancing crystallinity.

The content of the above-mentioned aliphatic dicarboxylic acid compound is preferably 80 mol % to 100 mol % in the carboxylic acid component.

A carboxylic acid component other than the aforementioned aliphatic dicarboxylic acid compounds may be contained as a carboxylic acid component for obtaining the crystalline polyester resin. Examples thereof include, but are not limited to, aromatic dicarboxylic acid compounds and aromatic polyvalent carboxylic acid compounds having a valence of three or more. Aromatic dicarboxylic acid compounds also include aromatic dicarboxylic acid derivatives. Specific examples of aromatic dicarboxylic acid compounds preferably include aromatic dicarboxylic acids such as phthalic acid, isophthalic acid or terephthalic acid, anhydrides of these acids and alkyl esters thereof (having 1 to 3 carbon atoms). Examples of the alkyl group in the alkyl esters include a methyl group, ethyl group, propyl group and isopropyl group. Examples of polyvalent carboxylic acid compounds having a valence of three or more include aromatic carboxylic acids such as 1,2,4-benzenetricarboxylic acid (trimellitic acid), 2,5,7-naphthalenetricarboxylic acid or pyromellitic acid, acid anhydrides thereof and alkyl esters (having 1 to 3 carbon atoms) thereof.

The molar ratio of the raw material monomers of the crystalline polyester resin in terms of the molar ratio of the carboxylic acid component to the alcohol component (carboxylic acid component/alcohol component) is preferably 0.80 to 1.20.

In addition, the weight-average molecular weight Mw of the crystalline polyester resin is 7,000 to 100,000 and preferably 8,000 to 45,000.

Low-temperature fixability can be made favorable while inhibiting sublimation as a result of making the weight-average molecular weight to be within the above-mentioned ranges, thereby making this preferable.

In the present invention, the content of the crystalline resin is preferably 1.0 parts by mass to 10.0 parts by mass, and more preferably 1.5 parts by mass to 7.5 parts by mass, based on 100 parts by mass of resin other than crystalline resin contained in the toner (so-called binder resin).

If the crystalline resin content is within the above-mentioned ranges, improvement of both low-temperature fixability and storage stability can be achieved.

There are no particular limitations on the production method of the toner particle of the present invention, and a so-called pulverization method can be used in which a resin component and, as necessary, toner constituent materials such as a colorant, release agent or charge control agent, are uniformly mixed followed by melting and kneading and cooling the resulting mixture, pulverizing, classifying and adequately mixing in a flowability improver and the like using a mixer such as a Henschel mixer to obtain the developer of the present invention.

Examples of other methods used to produce a toner particle include so-called polymerization methods such as an emulsion polymerization method and a suspension polymerization method.

The following method can be used to produce a toner particle obtained by at least going through a melting and kneading step and a pulverization step. A resin component and, as necessary, a wax, colorant, charge control agent or other additive, are adequately mixed with a mixer in the manner of a Henschel mixer or ball mill. The mixture is then melted and kneaded using a heated kneading machine in the manner of a twin-screw kneading extruder, heating roll, kneader or extruder. At that time, wax, magnetic iron oxide particles and metal-containing compounds can also be added. After solidifying the molten kneaded product by cooling, pulverization and classification are carried out to obtain a toner particle. Moreover, the toner particle can be mixed with an external additive with a mixer in the manner of a Henschel mixer to obtain a toner.

Examples of mixers include a Henschel mixer (Nippon Coke & Engineering Co., Ltd.), Super Mixer (Kawata Mfg. Co., Ltd.), revolving cone mixer (Okawara Mfg. Co., Ltd.), Nauta mixer, Tabulizer and Cyclo Mixer (Hosokawa Micron Ltd.), spiral bin mixer (Pacific Machinery & Engineering Co., Ltd.) and Loedige mixer (Matsubo Corp.). Examples of kneaders include a KRC kneader (Kurimoto, Ltd.), Buss co-kneader (Buss Corp.), TEM-type extruder (Toshiba Machine Co., Ltd.), TEX twin-screw kneader (Japan Steel Works, Ltd.), PCM Kneader (Ikegai Corp.), 3-roll mill, mixing roll mill, Kneader (Inoue Mfg., Inc.) Kneadex (Mitsui Mining Co., Ltd.), MS-type pressurized kneader, Nida Ruder (Moriyama Mfg. Co., Ltd.) and Banbury mixer (Kobe Steel Ltd.). Examples of pulverizers include a counter jet mill, Micron jet and Inomizer (Hosokawa Micron Ltd.), IDS-type mill and PJM Jet Pulverizer (Nippon Pneumatic Mfg. Co., Ltd.), Cross Jet Mill (Kurimoto, Ltd.), Ulmax (Nisso Engineering Co., Ltd.), SK Jet-O-Mill (Seishin Enterprise Co., Ltd.), Kryptron (Kawasaki Heavy Industries, Ltd.), Turbo Mill (Freund-Turbo Corp.) and Super Rotor (Nisso Engineering Co., Ltd.).

Examples of classifiers include the Classiel, Micron Classifier and Spedic Classifier (Seishin Enterprise Co., Ltd.), Turbo Classifier (Nissei Engineering Co., Ltd.), Micron Separator and Turbo Plex (ATP Co., Ltd.), TSP Separator (Hosokawa Micron Ltd.), Elbow Jet (Nittetsu Mining Co., Ltd.), Dispersion Separator (Nippon Pneumatic Mfg. Co., Ltd.) and YM Microcut (Yasukawa Corp.).

Examples of sieving devices used to sift coarse particles include Ultrasonic (Koeisangyo Corp.), Rezona Sieve and Gyro Shifter (Tokuju Corp.), Vibrasonic System (Dalton Co., Ltd.), Soniclean (Sintokogio Ltd.), Turbo Screener (Freund-Turbo Corp.), Micro Sifter (Makino Mfg. Co., Ltd.) and a circular vibrating sieving machine.

In addition, the toner of the present invention can be used as a magnetic single-component toner, non-magnetic single-component toner or non-magnetic two-component toner.

In the case of using as a magnetic single-component toner, magnetic iron oxide particles are preferably used as colorant. Examples of magnetic iron oxide particles contained in the magnetic single-component toner include magnetic iron oxide in the manner of magnetite, maghemite or ferrite, magnetic iron oxides containing other metal oxides, metals in the manner of Fe, Co or Ni, alloys of these metals and metals in the manner of Al, Co, Cu, Pb, Mg, Ni, Sn, Zn, Sb, Be, Bi, Cd, Ca, Mn, Se, Ti, W or V, and mixtures thereof.

Examples of colorants in the case of using as a non-magnetic single-component toner or non-magnetic two-component toner are indicated below.

Examples of black pigments used include carbon black pigments such as furnace black, channel black, acetylene black, thermal black or lamp black, and magnetic powders such as magnetite or ferrite are also used.

Pigments or dyes can be used as preferable colorants for yellow color. Examples of pigments include C.I. Pigment Yellow 1, 2, 3, 4, 5, 6, 7, 10, 11, 12, 13, 14, 15, 17, 23, 62, 65, 73, 74, 81, 83, 93, 94, 95, 97, 98, 109, 110, 111, 117, 120, 127, 128, 129, 137, 138, 139, 147, 151, 154, 155, 167, 168, 173, 174, 176, 180, 181, 183 and 191, and C.I. Vat Yellow 1, 3 and 20. Examples of dyes include C.I. Solvent Yellow 19, 44, 77, 79, 81, 82, 93, 98, 103, 104, 112 and 162. These are used alone or two or more are used in combination.

Pigments or dyes can be used as preferable colorants for cyan color. Examples of pigments include C.I. Pigment Blue 1, 7, 15, 15:1, 15:2, 15:3, 15:4, 16, 17, 60, 62 and 66, C.I. Vat Blue 6 and C.I. Acid Blue 45. Examples of dyes include C.I. Solvent Blue 25, 36, 60, 70, 93 and 95. These are used alone or two or more are used in combination.

Pigments or dyes can be used as preferable colorants for magenta color. Examples of pigments include C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 48:2, 48:3, 48:4, 49, 50, 51, 52, 53, 54, 55, 57, 57:1, 58, 60, 63, 64, 68, 81, 81:1, 83, 87, 88, 89, 90, 112, 114, 122, 123, 144, 146, 150, 163, 166, 169, 177, 184, 185, 202, 206, 207, 209, 220, 221, 238 and 254, C.I. Pigment Violet 19 and C.I. Vat Red 1, 2, 10, 13, 15, 23, 29 and 35. Examples of magenta dyes include oil-soluble dyes such as C.I. Solvent Red 1, 3, 8, 23, 24, 25, 27, 30, 49, 52, 58, 63, 81, 82, 83, 84, 100, 109, 111, 121 and 122, C.I. Disperse Red 9, C.I. Solvent Violet 8, 13, 14, 21 and 27 or C.I. Disperse Violet 1, and basic dyes such as C.I. Basic Red 1, 2, 9, 12, 13, 14, 15, 17, 18, 22, 23, 24, 27, 29, 32, 34, 35, 36, 37, 38, 39 and 40, and C.I. Basic Violet 1, 3, 7, 10, 14, 15, 21, 25, 26, 27 and 28. These are used alone or two or more types are used in combination.

In addition, the toner of the present invention preferably contains a release agent (wax) in order to impart favorable releasability to the toner. Hydrocarbon wax in the manner of low molecular weight polyethylene, low molecular weight polypropylene, microcrystalline wax or paraffin wax is used preferably for the wax due to its ease of dispersion in toner and is high releasability. The use of small amounts of one or two or more types of wax may be combined as necessary. Examples thereof are indicated below.

Examples of waxes include oxidized aliphatic hydrocarbon wax in the manner of oxidized polyethylene wax or block copolymers thereof, wax composed mainly of a fatty acid ester in the manner of carnauba wax, sasol wax or montanic acid ester wax, and partially or completely deoxidized fatty acid esters in the manner of deoxidized carnauba wax. Additional examples include saturated linear fatty acids in the manner of palmitic acid, stearic acid or montanic acid, unsaturated fatty acids in the manner of brassidic acid, eleostearic acid or parinaric acid, saturated alcohols in the manner of stearyl alcohol, aralkyl alcohol, behenyl alcohol, carnaubyl alcohol, ceryl alcohol or melissyl alcohol, long-chain alkyl alcohols, polyvalent alcohols in the manner of sorbitol, fatty acid amides in the manner of linoleic amide, oleic amide or lauric amide, saturated fatty acid bis-amides in the manner of methylene bis(stearic amide), ethylene bis(capric amide), ethylene bis(lauric amide) or hexamethylene bis(stearic amide), unsaturated fatty acid amides in the manner of ethylene bis(oleic amide), hexamethylene bis (oleic amide), N,N'-dioleyl adipic amide or N,N'-dioleyl sebacic amide, aromatic bis-amides in the manner of m-xylene bis(stearic amide) or N,N-distearyl isophthalic amide, aliphatic metal salts (commonly referred to as metal soaps) in the manner of calcium stearate, calcium laurate, zinc stearate or magnesium stearate, waxes obtained by grafting a vinyl-based monomer in the manner of styrene or acrylic acid to an aliphatic hydrocarbon wax, partial esterification products of a fatty acid and polyvalent alcohol in the manner of behenic acid monoglyceride, and methyl esterification products having a hydroxyl group obtained by hydrogenation of a vegetable oil.

Examples of waxes particularly preferably used in the present invention include aliphatic hydrocarbon waxes. Examples of such aliphatic hydrocarbon waxes include low molecular weight alkylene polymers obtained by radically polymerizing an alkylene under high pressure or polymerizing using a Ziegler catalyst under low atmospheric pressure, alkylene polymers obtained by thermal decomposition of a high molecular weight alkylene polymer, synthetic hydrocarbon waxes obtained from the distillation residue of a hydrocarbon obtained from a synthesis gas containing carbon monoxide and hydrogen according to the AG method and synthetic hydrocarbon waxes obtained by hydrogenation thereof, and waxes by fractionating these aliphatic hydrocarbon waxes by using the press sweating method, solvent method or vacuum distillation, or according to the fractional crystallization method.

Examples of hydrocarbons serving as the base of the aliphatic hydrocarbon wax include those synthesized by reacting carbon monoxide and hydrogen using a metal oxide-based catalyst (the majority of which consist of two or more types of multicomponent systems) (such as hydrocarbon compounds synthesized according to the synthol method or hydrocol method (using a fluidized catalyst bed)), hydrocarbons having up to about several hundred carbon atoms obtained by the AG method (using an identified catalyst bed) by which numerous wax-like hydrocarbons are obtained, and hydrocarbons obtained by polymerizing an alkylene in the manner of ethylene with a Ziegler catalyst. Specific examples thereof include VISKOL® 330-P, 550-P, 660-P and TS-200 (Sanyo Chemical Industries, Ltd.), Hi-Wax 400P, 200P, 100P, 410P, 420P, 320P, 220P, 210P and 110P (Mitsui Chemicals, Inc.), Sasol H1, H2, C80, C105 and C77 (Sasol Ltd.), HNP-1, HNP-3, HNP-9, HNP-10, HNP-11 and HNP-12 (Nippon Seiro Co., Ltd.), UNILIN® 350, 425, 550 and 700, UNICID® 350, 425, 550 and 700 (Toyo Petrolite Co., Ltd.), and Japan wax, beeswax, rice wax, candelilla wax and carnauba wax (Cerarica Noda Co., Ltd.).

Among the release agents, a release agent is more preferably contained for which the endothermic peak of the release agent is 100° C. or higher in order to efficiently obtain release effects.

In addition, although the timing at which the release agent is added is such that the release agent may be added during melting and kneading in the case of fabricating the toner by a pulverization method, it may also be added during production of toner resin. In addition, these release agents may be used alone or in combination. The release agent is preferably added at 1 part by mass to 20 parts by mass based on 100 parts by mass of binder resin other than the crystalline resin contained in the toner (resin component other than the crystalline resin contained in the toner).

A charge control agent can be used in the toner of the present invention to stabilize the triboelectric charging performance thereof. Although varying according to the type thereof and the physical properties of other toner particle constituent materials, the charge control agent is preferably contained in a toner particle at 0.1 parts by mass to 10.0 parts by mass, and more preferably at 0.1 parts by mass to 5.0 parts by mass, based on 100 parts by mass of the binder resin (resin component other than crystalline resin contained in the toner). Known examples of such a charge control agent include those that control the toner to negative charging performance and those that control the toner to positive charging performance, and one type or two or more types of various charge control agents can be used corresponding to the type and application of the toner.

Examples of charge control agents that control the toner to negative charging performance include organic metal complexes (monoazo metal complexes, acetyl acetone metal complexes) and metal complexes or metal salts of aromatic hydroxycarboxylic acids or aromatic dicarboxylic acids. Other examples of charge control agents that control the toner to negative charging performance include aromatic mono- and polycarboxylic acids and metal salts and anhydrides thereof, esters and phenol derivatives such as bisphenol. Among these, metal complexes or metal salts of aromatic hydroxycarboxylic acids are used preferably since they allow the obtaining of stable charging performance.

Examples of charge control agents that control the toner to positive charging performance include nigrosine and fatty acid metal salt modification products, quaternary ammonium salts such as tributylbenzylammonium-1-hydroxy-4-naphthosulfonate or tetrabutylammonium tetrafluoroborate and analogues thereof, onium salts in the manner of phosphonium salts and lake pigments thereof, triphenylmethane dyes and lake pigments thereof (and examples of laking agents include phosphotungstic acid, phosphomolybdic acid, phosphotungstomolybdic acid, tannic acid, lauric acid, gallic acid, ferricyanic acid and ferrocyanide compounds) and metal salts of higher fatty acids. In the present invention, one type of these can be used alone or two or more types can be used in combination. Examples of charge control agents that control the toner to positive charging performance that are used particularly preferably include nigrosine-based compounds and quaternary ammonium salts.

Specific examples of charge control agents that can be used include Spilon Black TRH, T-77, T-95 and TN-105 (Hodogaya Chemical Co., Ltd.) and BONTRON® S-34, S-44, E-84 and E-88 (Orient Chemical Industries Co., Ltd.). Specific examples of charge control agents for controlling the toner to positive charging performance include TP-302 and TP-415 (Hodogaya Chemical Co., Ltd.), BONTRON® N-01, N-04, N-07 and P-51 (Orient Chemical Industries Co., Ltd.) and Copy Blue PR (Clariant GmbH).

In addition, charge control resins can also be used, and these can be used in combination with the above-mentioned charge control agents.

The toner of the present invention may also be used as a two-component developer by mixing with a carrier. An ordinary carrier such as ferrite or magnetite or resin-coated carrier can be used for the carrier. In addition, a binder-type carrier core having magnetic powder dispersed in a resin can also be used.

Resin-coated carriers are composed of a resin in the form of a coating material that covers (coats) the carrier core particle surfaces and carrier core particles. Examples of resins used for the coating material include styrene-acrylic resins such as styrene-acrylic acid ester copolymers or styrene-methacrylic acid ester copolymers, acrylic resins such as acrylic acid ester copolymers and methacrylic acid ester copolymers, fluorine-containing resins such as polytetrafluoroethylene, monochlorotrifluoroethylene polymers and polyvinylidene fluoride, silicone resins, polyester resins, polyamide resins, polyvinyl butyral and aminoacrylate resins. Other examples include iomonomer resins and polyphenylene sulfide resins. These resins can be used alone or a plurality thereof can be used in combination.

Silica fine powder is preferably added externally to a toner particle in the toner of the present invention in order to improve charging stability, development durability, flowability and durability. The silica fine powder preferably has a specific surface area as determined according to the BET method by nitrogen adsorption of 30 $m^2/g$ or more and more preferably 50 $m^2/g$ to 400 $m^2/g$. In addition, the silica fine powder is preferably used at 0.01 parts by mass to 8.00 parts by mass, and more preferably at 0.10 parts by mass to 5.00 parts by mass, based on 100 parts by mass of the toner particle. The BET specific surface area of the silica fine powder can be calculated using the multipoint BET method by allowing nitrogen gas to adsorb onto the surface of the silica fine powder using, for example, the Autosorb 1 Specific Surface Area Measuring System (Yuasa Ionics Co., Ltd.), Gemini 2360/2375 (Micro Metallic Ltd.) or Tristar 3000 (Micro Metallic Ltd.).

The silica fine powder is preferably treated by combining with the use of various treatment agents or by treating with an unmodified silicone varnish, various types of modified varnish, an unmodified silicone oil, various types of modified silicone oils, silane coupling agent, silane compound having a functional group or other organic silicon compound for the purpose of making hydrophobic and controlling triboelectric charging performance.

Moreover, other external additives may also be added to the toner of the present invention as necessary. Examples of such external additives include resin fine particles or inorganic fine powder that function as charge assistants, electrical conductivity-imparting agents, flowability-imparting agents, anti-caking agents, release agents used during hot roller fixation, lubricants, or abrasive, etc. Examples of lubricants include polyethylene fluoride powder, zinc stearate powder and polyvinylidene fluoride powder. Examples of abrasives include cerium oxide powder, silicon carbide powder and strontium titanate powder, with strontium titanate powder being particularly preferable.

The following indicates methods used to measure physical properties according to the present invention.

<Measurement of Peak Temperature of Maximum Endothermic Peak of Crystalline Resin by Differential Scanning Calorimetric Measurement>

The peak temperature of the maximum endothermic peak of the crystalline resin was measured in compliance with ASTM D3418-82 using the "Q2000" differential scanning calorimeter (TA Instruments Inc.). The temperature of the detection unit of the calorimeter was calibrated using the melting points of indium and zinc and calorific value was calibrated using the heat of fusion of indium.

More specifically, about 2 mg of measurement sample are accurately weighed and placed in an aluminum pan followed by measuring at a constant temperature and constant humidity using the empty aluminum pan as a reference over a measuring temperature range of 30° C. to 200° C. at a ramp rate of 10° C./min. Furthermore, after initially raising the temperature to 200° C., the temperature is subsequently lowered to 30° C. at a drop rate of 10° C./min followed by again raising the temperature. The temperature corresponding to the top of the maximum endothermic peak over a temperature range of 30° C. to 200° C. on a DSC curve obtained during the course of the second round of heating is taken to be the peak temperature of the maximum endothermic peak.

The following provides a detailed explanation of the present invention by indicating examples thereof.

<Production Example of Long-Chain Alkyl Monomer Composition (a-1)>

1200 g of aliphatic hydrocarbons having an average of 35 carbon atoms were placed in a cylindrical glass reaction vessel followed by adding 38.5 g of boric acid at a temperature of 140° C., immediately blowing in a mixed gas consisting of 50% by volume of air and 50% by volume of nitrogen and having an oxygen concentration of about 10% by volume at the rate of 20 liters/minute, and allowing to react for 3.0 hours at 200° C. Subsequently, hot water was added to the reaction liquid followed by carrying out hydrolysis for 2 hours at 95° C. After allowing to stand undisturbed, a reaction product was obtained that was present in the upper layer of the liquid. 100 parts by mass of n-hexane were added to 20 parts by mass of the resulting reaction product to dissolve and remove any unmodified components and obtain a long-chain alkyl monomer composition (a-1). The physical properties of the resulting long-chain alkyl monomer composition (a-1) are shown in Table 2.

<Production Example of Long-Chain Alkyl Monomer Composition (a-2)>

20 parts by mass of long-chain alkylmonocarboxylic acid having an average of 35 carbon atoms and having a carboxyl group on an end thereof were added to 100 parts by mass of n-hexane to obtain a long-chain alkyl monomer composition (a-2) from which unmodified components had been dissolved and removed. The physical properties of the resulting long-chain alkyl monomer composition (a-2) are shown in Table 2.

<Production Example of Long-Chain Alkyl Monomer Composition (a-3)>

A long-chain alkyl monomer composition (a-3) was obtained in the same manner as in the production example of the long-chain alkyl monomer composition (a-1) with the exception of changing the conditions of purification by n-hexane (extraction time). The physical properties of the resulting long-chain alkyl monomer composition (a-3) are shown in Table 2.

<Production Examples of Long-Chain Alkyl Monomer Compositions (a-4) to (a-7) and (a-9) to (a-12)>

Long-chain alkyl monomer compositions (a-4) to (a-7) and (a-9) to (a-12) were obtained using the monomers described in Table 2 and adjusting the amount of unmodified components by suitably changing the conditions of purification by n-hexane (extraction time) in the production example of the long-chain alkyl monomer composition (a-1). The physical properties of the resulting long-chain alkyl monomer compositions are shown in Table 2.

<Production Example of Long-Chain Alkyl Monomer Composition (a-8)>

1200 g of aliphatic hydrocarbons having an average of 30 carbon atoms were placed in a cylindrical glass reaction vessel followed by adding 38.5 g of boric acid at a temperature of 140° C., immediately blowing in a mixed gas consisting of 50% by volume of air and 50% by volume of nitrogen and having an oxygen concentration of about 10% by volume at the rate of 20 liters/minute and allowing to react for 2.5 hours at 170° C., followed by adding hot water to the reaction liquid and carrying out hydrolysis for 2 hours at 95° C. to obtain a long-chain alkyl monomer composition (a-8). The physical properties of the resulting long-chain alkyl monomer composition (a-8) are shown in Table 2.

TABLE 2

| Long-chain alkyl monomer composition no. | Type of long-chain monomer | Average no. of carbon atoms of long-chain monomer | Modification rate (%) |
|---|---|---|---|
| a-1 | Saturated monoalcohol modification product (secondary) | 35 | 93.5 |
| a-2 | Saturated monocarboxylic acid modification product | 35 | 77.8 |
| a-3 | Saturated monoalcohol modification product (secondary) | 35 | 98.5 |
| a-4 | Saturated monoalcohol modification product (secondary) | 30 | 95.2 |
| a-5 | Saturated monoalcohol modification product (secondary) | 27 | 95.3 |
| a-6 | Saturated monoalcohol modification product (primary) | 40 | 85.0 |
| a-7 | Saturated monoalcohol modification product (primary) | 50 | 81.5 |
| a-8 | Saturated monoalcohol modification product (secondary) | 30 | 50.5 |
| a-9 | Saturated monoalcohol modification product (secondary) | 27 | 75.0 |
| a-10 | Saturated monoalcohol modification product (secondary) | 40 | 99.2 |
| a-11 | Saturated monoalcohol modification product (secondary) | 25 | 91.6 |
| a-12 | Saturated monoalcohol modification product (secondary) | 55 | 93.5 |

<Production Example of Toner Resin (A-1)>

| | |
|---|---|
| Bisphenol A ethylene oxide adduct (addition of 2.0 moles) | 50.0 molar parts |
| Bisphenol A propylene oxide adduct (addition of 2.3 moles) | 50.0 molar parts |
| Terephthalic acid | 60.0 molar parts |
| Trimellitic anhydride | 20.0 molar parts |
| Acrylic acid | 10.0 molar parts |

70 parts by mass of a mixture obtained by adding the long-chain alkyl monomer composition (a-1) at 5.0% by mass based on the total mass of the toner resin (A-1) in addition to the above-mentioned polyester monomers were charged into a four-mouth flask followed by attaching a pressure reducing device, water separation device, nitrogen gas introduction device, temperature measuring device and stirring device, and stirring in a nitrogen atmosphere at 160° C. Mixture of 30 parts by mass of a vinyl-based polymerization monomer composing a vinyl polymer segment (styrene: 60.0 molar parts, 2-ethylhexyl acrylate: 40.0 molar parts) and 2.0 molar parts of a polymerization initiator in the form of benzoyl peroxide was dropped therein over the course of 4 hours using a dropping funnel. After reacting for 5 hours at 160° C., the temperature was raised to 230° C. followed by adding 0.05% by mass of tetraisobutyl titanate and adjusting the reaction time so as to obtain a desired viscosity.

Following completion of the reaction, the reaction product was removed from the vessel, cooled and pulverized to obtain a hybrid resin in the form of toner resin (A-1). The physical properties of the resulting toner resin (A-1) are shown in Table 3.

<Production Examples of Toner Resins (A-2) to (A-5), (A-7), (A-8), (A-11) and (A-12)>

Toner resins (A-2) to (A-5), (A-7), (A-8), (A-11) and (A-12) were obtained in the same manner as the production example of the toner resin (A–1) with the exception of changing to the monomer formulations described in Table 3. The physical properties of the resulting toner resins are shown in Table 3.

<Production Example of Toner Resin (A-6)>

The monomers described in Table 3 were charged into a five-liter autoclave together with 0.05% by mass of tetraisobutyl titanate based on the total monomer mass followed by attaching a reflux condenser, moisture separation device, nitrogen gas feed tube, thermometer and stirring device and carrying out a polymerization reaction at 230° C. while introducing nitrogen gas into the autoclave. The reaction time was adjusted so as to obtain a desired softening point. Subsequently, a long-chain alkyl monomer composition was added at a prescribed amount based on the toner resin (A-6) followed by raising the temperature to 200° C. under reduced pressure and adjusting the reaction time so as to obtain a desired viscosity. Following completion of the reaction, the reaction product was removed from the vessel, cooled and pulverized to obtain the toner resin (A-6). The physical properties of the resulting toner resin (A-6) are shown in Table 3.

<Production Examples of Toner Resins (A-9), (A-10), (A-13) and (A-14)>

Toner resins (A-9), (A-10), (A-13) and (A-14) were obtained in the same manner as the production example of the toner resin (A-6) with the exception of changing to the monomer formulations described in Table 3. The physical properties of the resulting toner resins are shown in Table 3.

<Production Example of Toner Resin (A-15)>

| | |
|---|---|
| Bisphenol A ethylene oxide adduct (addition of 2.0 moles) | 50.0 molar parts |
| Bisphenol A propylene oxide adduct (addition of 2.3 moles) | 50.0 molar parts |
| Terephthalic acid | 60.0 molar parts |
| Trimellitic anhydride | 20.0 molar parts |
| Acrylic acid | 10.0 molar parts |

70 parts by mass of the above-mentioned polyester monomers were charged into a four-mouth flask followed by attaching a pressure reducing device, water separation device, nitrogen gas introduction device, temperature measuring device and stirring device, and stirring in a nitrogen atmosphere at 160° C. Mixture of 30 parts by mass of a vinyl-based polymerization monomer composing a vinyl polymer segment (styrene: 60.0 molar parts, 2-ethylhexyl acrylate: 40.0 molar parts) and 2.0 molar parts of a polymerization initiator in the form of benzoyl peroxide was dropped therein over the course of 4 hours using a dropping funnel. After reacting for 5 hours at 160° C., the temperature was raised to 230° C. followed by adding 0.05% by mass of tetraisobutyl titanate and adjusting the reaction time so as to obtain a desired viscosity.

Following completion of the reaction, a long-chain alkyl component in the form of Paracol 5070 (Nippon Seiro Co., Ltd.) was added at 2% based on the resin and stirred. The reaction product was removed from the vessel, cooled and pulverized to obtain a hybrid resin in the form of toner resin (A-15). The physical properties of the resulting toner resin (A-15) are shown in Table 3.

<Production Example of Toner Resin (A-16)>

Toner resin (A-16) was obtained in the same manner as the production example of toner resin (A-6) with the exception of changing to the formulation shown in Table 3. The physical properties of the resulting toner resin (A-16) are shown in Table 3.

TABLE 3

| | Charged composition of polyester resin component (*1) | | | | | | | | | | | | |
|---|---|---|---|---|---|---|---|---|---|---|---|---|---|
| | | | | | | | Long-chain alkyl monomer composition | | Charged composition of StAc resin component (*2) | | | | |
| Resin A | BPA-PO (molar parts) | BPA-EO (molar parts) | EG (molar parts) | TPA (molar parts) | TMA (molar parts) | Acrylic acid (molar parts) | Type | Ratio (mass %) (*3) | St (molar parts) | 2EHA (molar parts) | PES/StAc ratio | Tg (° C.) | Tm (° C.) |
| A-1 | 50.0 | 50.0 | — | 60.0 | 20.0 | 10.0 | a-1 | 5.0 | 60 | 40 | 70/30 | 54.9 | 131.5 |
| A-2 | 50.0 | 50.0 | — | 60.0 | 20.0 | 10.0 | a-1 | 5.0 | 60 | 40 | 70/30 | 54.3 | 115.6 |
| A-3 | 50.0 | 50.0 | — | 60.0 | 20.0 | 10.0 | a-2 | 5.0 | 60 | 40 | 70/30 | 55.2 | 132.6 |
| A-4 | 50.0 | 50.0 | — | 60.0 | 20.0 | 10.0 | a-3 | 5.0 | 60 | 40 | 70/30 | 54.8 | 130.5 |
| A-5 | 40.0 | 60.0 | — | 60.0 | 20.0 | 10.0 | a-4 | 10.0 | 60 | 40 | 90/10 | 56.0 | 132.5 |
| A-6 | 30.0 | 70.0 | — | 60.0 | 20.0 | 10.0 | a-5 | 11.0 | — | — | 100/0 | 56.4 | 132.7 |
| A-7 | 60.0 | 40.0 | — | 60.0 | 20.0 | 10.0 | a-6 | 2.5 | 60 | 40 | 50/50 | 56.2 | 132.5 |
| A-8 | 70.0 | 30.0 | — | 60.0 | 20.0 | 10.0 | a-7 | 2.0 | 60 | 40 | 40/60 | 55.6 | 131.5 |
| A-9 | 40.0 | 60.0 | | 60.0 | 20.0 | 10.0 | a-8 | 5.0 | — | — | 100/0 | 56.2 | 130.8 |

TABLE 3-continued

| Resin A | Charged composition of polyester resin component (*1) BPA-PO (molar parts) | BPA-EO (molar parts) | EG (molar parts) | TPA (molar parts) | TMA (molar parts) | Acrylic acid (molar parts) | Long-chain alkyl monomer composition Type | Ratio (mass %) (*3) | Charged composition of StAc resin component (*2) St (molar parts) | 2EHA (molar parts) | PES/StAc ratio | Tg (° C.) | Tm (° C.) |
|---|---|---|---|---|---|---|---|---|---|---|---|---|---|
| A-10 | 30.0 | 70.0 | | 60.0 | 20.0 | 10.0 | a-9 | 5.0 | — | — | 100/0 | 55.7 | 131.7 |
| A-11 | 60.0 | 40.0 | — | 60.0 | 20.0 | 10.0 | a-10 | 5.0 | 60 | 40 | 50/50 | 56.1 | 132.6 |
| A-12 | 70.0 | 30.0 | | 60.0 | 20.0 | 10.0 | a-8 | 0.9 | 60 | 40 | 40/60 | 55.8 | 130.6 |
| A-13 | 40.0 | 60.0 | | 60.0 | 20.0 | 10.0 | a-11 | 5.0 | — | — | 100/0 | 56.4 | 132.6 |
| A-14 | 30.0 | 70.0 | | 60.0 | 20.0 | 10.0 | a-12 | 5.0 | — | — | 100/0 | 55.8 | 131.6 |
| A-15 | 50.0 | 50.0 | — | 60.0 | 20.0 | 10.0 | Paracol 5070 | 2.0 | 60 | 40 | 70/30 | 54.6 | 132.5 |
| A-16 | 35.0 | 45.0 | 20.0 | 85.0 | — | — | — | — | — | — | 100/0 | 53.6 | 90.6 |

BPA-PO: Bisphenol A propylene oxide adduct (addition of 2.3 moles)
BPA-EO: Bisphenol A ethylene oxide adduct (addition of 2.0 moles)
EG: Ethylene glycol
TPA: Terephthalic acid
TMA: Trimellitic anhydride
St: Styrene
2EHA: 2-ethylhexyl acrylate
*1: The molar parts of monomers in the table indicate the ratio when the total amount of the alcohol component (excluding the long-chain alkyl monomer) is taken to be 100 moles.
*2: The molar parts of monomers in the table indicate the ratio when the total amount of the StAc resin component is taken to be 100 moles.
*3: The ratio of the long-chain alkyl monomer component indicates the % by mass based on the total mass of synthesized resin A.

<Production Example of Crystalline Resin (B-1)>

| | |
|---|---|
| 1,12-dodecanediol | 100.0 molar parts |
| Sebacic acid | 100.0 molar parts |

1.0% by mass of 0.2% by mass tetraisobutyl titanate based on the total mass of the aforementioned monomer was placed in a 10-liter four-mouth flask equipped with a nitrogen feed tube, water drain tube, stirring device and thermocouple, and after reacting for 4 hours at 180° C., the temperature was raised to 210° C. at a ramp rate of 10° C./hour followed by holding at 210° C. for 8 hours and reacting for 1 hour at 8.3 kPa to obtain a crystalline resin (B-1).

The SP value $(cal/cm^3)^{1/2}$ and temperature of an endothermic peak as determined by DSC measurement of the resulting crystalline resin (B-1) are shown in Table 4.

<Production Examples of Crystalline Resins (B-2) to (B-8)>

Crystalline polyester resins (B-2) to (B-8) were obtained in the same manner as the production example of crystalline resin (B-1) with the exception of changing to the monomer formulations described in Table 4. The physical properties of these resins are shown in Table 4.

TABLE 4

| | Alcohol component | Molar ratio | Acid component | Molar ratio | SP value $(cal/cm^3)^{1/2}$ | Endothermic peak (° C.) |
|---|---|---|---|---|---|---|
| B-1 | 1,12-dodecanediol | 100.0 | Decanedioic acid | 100.0 | 9.77 | 84.1 |
| B-2 | 1,10-decanediol | 100.0 | Decanedioic acid | 100.0 | 9.91 | 74.1 |
| B-3 | 1,6-hexanediol | 100.0 | Hexanedioic acid | 100.0 | 10.97 | 56.8 |
| B-4 | 1,4-butanediol | 100.0 | Pentanedioic acid | 100.0 | 11.75 | 49.8 |
| B-5 | Tetradecane-1,14-diol | 100.0 | Dodecanedioic acid | 100.0 | 9.51 | 87.6 |
| B-6 | 1,20-eicosanediol | 100.0 | Eicosandioic acid | 100.0 | 9.01 | 101.5 |
| B-7 | 1,4-butanediol | 100.0 | Butanedioic acid | 100.0 | 12.11 | 56.2 |
| B-8 | 1,20-eicosanediol | 100.0 | Henicosanedioic acid | 100.0 | 8.98 | 101.2 |

Example 1

| | |
|---|---|
| Toner resin (A-1) | 55 parts by mass |
| Toner resin (A-16) | 45 parts by mass |
| Crystalline resin (B-1) | 2.5 parts by mass |
| Magnetic iron oxide particles (mean particle diameter: 0.13 μm, Hc = 11.5 kA/m, σs = 88 $Am^2/kg$, σr = 14 $Am^2/kg$) | 60 parts by mass |
| Release agent: Fischer-Tropsch wax (C105, Sasol Ltd., melting point: 105° C.) | 2 parts by mass |
| Charge control agent: T-77 (Hodogaya Chemical Co., Ltd.) | 2 parts by mass |

The above-mentioned materials were pre-mixed with a Henschel mixer followed by melting and kneading with a twin-screw kneading extruder (Model PCM-30, Ikegai Corp.).

After cooling the resulting kneaded product and coarsely pulverizing with a hammer mill, the coarsely pulverized powder was pulverized with a mechanical pulverizer (Model T-250, Freund-Turbo Corp.), and the resulting finely pulverized powder was classified using a multi-grade classifier utilizing the Coanda effect to obtain a negatively-charged toner particle having a weight-average particle diameter (D4) of 7.0 μm.

1.0 part by mass of hydrophobic silica fine powder 1 (BET specific surface area: 150 $m^2/g$, subjected to hydrophobic treatment with 30 parts of hexamethyldisilazane (HMDS) and 10 parts of dimethyl silicone oil based on 100 parts of the silica fine powder prior to hydrophobic treatment) and 0.6 parts by mass of strontium titanate fine powder (D50: 1.0 μm) were mixed with 100 parts by mass of a toner particle with a Henschel mixer (Model FM-75, Nippon Coke & Engineering Co., Ltd.) followed by sieving with a 150 μm mesh sieve to obtain a toner (T-1).

The amount of volatile components of saturated hydrocarbons having 30 to 37 carbon atoms in the toner (T-1) was measured using a thermal desorption device, the results of which are shown in Table 5. In addition, the following evaluations were carried out on the toner (T-1).

<Storability Evaluation Test>

10 g of toner were weighed out into a 50 ml plastic cup followed by allowing to stand for 3 days in a constant temperature bath at 55° C. After standing, the toner was observed visually and blocking was evaluated according to the criteria indicated below.

A (extremely good): Toner immediately broke up when cup rotated

B (good): Clumping, but small pieces broke up when cup rotated

C (average): Clumps remained even if clumps were attempted to be broken up by rotating cup D (poor): Large clumps that were unable to be broken up even by rotating cup The results are shown in Table 6.

<Evaluation of Low-Temperature Fixability>

Low-temperature fixability was evaluated by preparing a laser beam printer in the form of the HP LaserJet Enterprise 600 M603 manufactured by Hewlett-Packard Co. after removing the fixing unit. In addition, the removed fixing unit was modified so as to enable the temperature to be set arbitrarily and to a processing speed of 440 mm/sec.

Unfixed images having a toner mounting amount of 0.5 $mg/cm^2$ per unit area were produced using the above-mentioned printer in a normal temperature, normal humidity environment (temperature: 23.5° C., humidity: 60% RH) and low temperature, low humidity environment (temperature: 15° C., humidity: 10% RH). Next, the unfixed images were passed through the above-mentioned fixing unit controlled to a temperature of 160° C. Furthermore, "Proper Bond Sheet" (105 $g/m^2$, Fox River Corp.) was used for the recording medium. The resulting fixed images were rubbed five times back and forthwith lens-cleaning paper while applying a load of 4.9 kPa (50 $g/cm^2$) followed by evaluating the rate of decrease (%) in image density before and after rubbing.

A (extremely good): Rate of decrease in image density of less than 5.0%

B (good): Rate of decrease in image density of 5.0% to less than 10%

C (average): Rate of decrease in image density of 10.0% to less than 15.0%

D (poor): Rate of decrease in image density of 15.0% or more

The results are shown in Table 6.

<Evaluation of Fogging>

Fogging was evaluated using the HP LaserJet Enterprise 600 M603 laser beam printer manufactured by Hewlett-Packard Co. 100,000 sheets were printed out using that printer in test environments respectively consisting of a normal temperature, normal humidity environment (temperature: 23.5° C., humidity: 60% RH) and low temperature, low humidity environment (temperature: 15° C., humidity: 10% RH) followed by printing out one image having a white background. The reflectance of the resulting image was measured using a reflectometer (Model TC-6DS Reflectometer, Tokyo Denshoku Co., Ltd.). A green filter was used during measurement. When Ds (%) was defined as the worst value of white background reflectance and Dr (%) was defined as the reflectance of the transfer material prior to image formation, the value of Dr-Ds was taken to represent fogging and this was evaluated according to the criteria indicated below.

A (extremely good): Fogging of less than 1%

B (good): Fogging of 1% to less than 3%

C (average): Fogging of 3% to less than 5%

D (poor): Fogging of 5% or more

<Image Density in High Temperature, High Humidity Environment>

500 sheets were printed out using the HP LaserJet Enterprise 600 M603 laser beam printer manufactured by Hewlett-Packard Co. in a high temperature, high humidity environment (temperature: 32.5° C., humidity: 80% RH). Subsequently, a solid black image was printed out and image density was calculated at five locations consisting of the four corners and center of the image followed by calculating the average value thereof.

A (extremely good): Average image density of 1.45 or more

B (good): Average image density of 1.35 to less than 1.45

C (average): Average image density of 1.25 to less than 1.35

D (poor): Average image density of less than 1.25

Examples 2 to 8

Toners (T-2) to (T-8) were fabricated in the same manner as Example 1 using the formulations described in Table 5. The same evaluations as Example 1 were carried out on the resulting toners. The results are shown in Table 6.

Comparative Examples 1 to 7

Toners (T-9) to (T-15) were fabricated in the same manner as Example 1 using the formulations described in Table 5.

The same evaluations as Example 1 were carried out on the resulting toners. The results are shown in Table 6.

TABLE 5

| Toner No. | | T-1 | T-2 | T-3 | T-4 | T-5 | T-6 | T-7 | T-8 | T-9 | T-10 | T-11 | T-12 | T-13 | T-14 | T-15 |
|---|---|---|---|---|---|---|---|---|---|---|---|---|---|---|---|---|
| Resin 1 | Type | A-1 | A-2 | A-3 | A-4 | A-5 | A-6 | A-7 | A-8 | A-9 | A-10 | A-11 | A-12 | A-13 | A-14 | A-15 |
| | Added amount (parts by mass) | 55 | 100 | 55 | 55 | 55 | 55 | 55 | 55 | 55 | 55 | 55 | 55 | 55 | 55 | 55 |
| Resin 2 | Type | A-16 | — | A-16 | A-16 | A-16 | A-16 | A-16 | A-16 | A-16 | A-16 | A-16 | A-16 | A-16 | A-16 | A-16 |
| | Added amount (parts by mass) | 45 | — | 45 | 45 | 45 | 45 | 45 | 45 | 45 | 45 | 45 | 45 | 45 | 45 | 45 |
| Crystalline resin | Type | B-1 | B-1 | B-2 | B-1 | B-3 | B-4 | B-5 | B-6 | B-3 | B-4 | B-5 | B-6 | B-7 | B-8 | B-1 |
| | Added amount (parts by mass) | 2.5 | 2.5 | 1.5 | 7.5 | 10.0 | 12.0 | 1.0 | 0.5 | 2.5 | 2.5 | 2.5 | 0.5 | 5.0 | 5.0 | 2.5 |
| Amount of volatile components of saturated hydrocarbons having 30 to 37 carbon atoms (ppm) | | 132.0 | 240.0 | 259.0 | 92.0 | 236.0 | 258.0 | 100.0 | 92.0 | 480.0 | 282.0 | 86.0 | 86.0 | 147.0 | 132.0 | 509.0 |

TABLE 6

| | | Examples | | | | | | | | Comparative Examples | | | | | | |
|---|---|---|---|---|---|---|---|---|---|---|---|---|---|---|---|---|
| Toner No. | | 1 T-1 | 2 T-2 | 3 T-3 | 4 T-4 | 5 T-5 | 6 T-6 | 7 T-7 | 8 T-8 | 1 T-9 | 2 T-10 | 3 T-11 | 4 T-12 | 5 T-13 | 6 T-14 | 7 T-15 |
| Storability | | A | A | A | A | B | C | B | C | B | C | A | C | D | C | A |
| Low-temperature fixability (upper row: rank/lower row: density decrease (%)) | Normal temperature, normal humidity | A 2.7 | A 2.9 | A 3.9 | A 3.6 | A 2.9 | A 2.7 | A 3.6 | B 7.5 | A 3.5 | A 3.7 | B 6.2 | C 11.6 | A 4.9 | D 15.6 | A 4.8 |
| | Low temperature, low humidity | A 4.2 | A 4.3 | A 4.8 | A 4.2 | A 4.3 | A 4.1 | B 5.3 | C 10.5 | A 4.6 | A 4.9 | C 10.5 | C 14.6 | B 6.9 | D 17.6 | B 7.2 |
| Fogging (upper row: rank/lower row: fogging value) | Normal temperature, normal humidity | A 0.5 | A 0.8 | B 2.1 | B 2.6 | A 0.9 | B 2.5 | A 0.7 | B 2.6 | D 5.2 | D 5.6 | D 5.7 | D 5.4 | A 0.9 | B 1.9 | D 5.2 |
| | Low temperature, low humidity | A 0.8 | B 1.5 | C 3.6 | C 4.3 | B 2.8 | C 4.5 | B 2.9 | C 4.8 | D 5.9 | D 6.1 | D 6.3 | D 6.5 | B 2.1 | C 3.6 | D 5.7 |
| HH density (upper row: rank/lower row: image density) | | A 1.45 | A 1.49 | A 1.47 | A 1.45 | B 1.38 | C 1.34 | B 1.40 | A 1.45 | C 1.33 | C 1.31 | B 1.39 | A 1.45 | C 1.32 | C 1.31 | A 1.45 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-200109, filed Sep. 30, 2014, which is hereby incorporated by reference herein in its entirety.

What is claimed is:

1. A toner having a toner particle comprising a resin A, which has a long-chain alkyl group having an average number of carbon atoms of 27 to 50, and a crystalline resin, wherein the SP value $(cal/cm^3)^{1/2}$ of the crystalline resin is 9.00 to 12.00, in a GC/MS analysis of components that volatize when the toner is heated for 10 minutes at 200° C., an amount of volatile components of saturated hydrocarbons having 30 to 37 carbon atoms is 90 ppm to 260 ppm of toluene equivalent, based on mass, and the resin A is a hybrid resin in which a polyester segment and a vinyl-based polymer segment are chemically bonded and a mass ratio of the polyester segment to the vinyl-based polymer segment (polyester segment/vinyl-based polymer segment) in the resin A is 50/50 to 90/10.

2. The toner according to claim 1, wherein the peak temperature of the maximum endothermic peak of the crystalline resin as measured by differential scanning calorimetric measurement is 50.0° C. to 100.0° C.

* * * * *